United States Patent [19]

Ringe et al.

[11] 3,996,890

[45] Dec. 14, 1976

[54] APPARATUS FOR FORMING AND TRANSFERRING THIN LIQUID LAYERS

[75] Inventors: Werner Ringe, Geesthacht; Jürgen Gömann, Dassendorf, both of Germany

[73] Assignee: Hauni-Werke Korber & Co., KG, Hamburg, Germany

[22] Filed: June 21, 1974

[21] Appl. No.: 481,859

[30] Foreign Application Priority Data

June 28, 1973 Germany ..... 2332920

[52] U.S. Cl. ..... 118/262

[51] Int. Cl.[2] ..... B05C 1/08

[58] Field of Search ..... 118/258, 259, 261, 262, 118/13; 101/315, 167; 401/208; 308/36.1

[56] References Cited

UNITED STATES PATENTS

| | | | |
|---|---|---|---|
| 2,158,495 | 5/1939 | Crighton et al. | 118/259 |
| 2,641,220 | 6/1953 | Weber et al. | 118/261 X |
| 2,774,330 | 12/1956 | Schaefer | 118/259 |
| 2,787,244 | 4/1957 | Hickin | 118/259 |
| 2,929,352 | 3/1960 | Dearsley | 118/261 |
| 3,203,393 | 8/1965 | Colwill | 118/413 X |
| 3,352,279 | 11/1967 | Lockwood | 118/261 X |

*Primary Examiner*—John P. McIntosh
*Attorney, Agent, or Firm*—Peter K. Kontler; John Kurucz

[57] ABSTRACT

An apparatus which forms and transfers thin films of a viscous or freely flowable liquid has a housing which supports or includes a vessel for a supply of liquid, a fountain roll which is rotatable in the housing and a median portion of which extends transversely of an outlet of the vessel so that liquid which flows into the outlet forms a layer on the periphery of the median portion, and a cylindrical doctor having at one end a diametrically extending blade which defines with the periphery of the median portion of the fountain roll a narrow clearance through which a film of liquid passes toward a station where the film is transferred onto a ductor roll. The doctor is adjustable radially of the fountain roll and the latter is surrounded by two O-rings which prevent the liquid layer from spreading from the median portion to the end faces of the fountain roll. A further O-ring is mounted in the housing to sealingly engage and to prevent leakage of liquid along the periphery of the doctor.

14 Claims, 2 Drawing Figures

APPARATUS FOR FORMING AND TRANSFERRING THIN LIQUID LAYERS

BACKGROUND OF THE INVENTION

The present invention relates to apparatus for forming and transferring thin films of ink, adhesive paste or other liquids. More particularly, the invention relates to improvements in apparatus wherein a continuous layer of liquid is being withdrawn from a vessel by a rotary member known as a fountain roll. Still more particularly, the invention relates to improvements in apparatus which can be used with particular advantage in tobacco processing machines for the application of thin films of a liquid to webs of cigarette paper, to blanks which are employed for the making of packs for cigarettes or the like, to strips which are to form adhesive-coated uniting bands, or the like.

As a rule, an apparatus which is to form a thin film of ink, adhesive or other liquid material comprises a vessel or tank which contains a supply of liquid and supports the shaft of a roll a portion of which dips into the supply of liquid so that the periphery of the roll withdraws from the supply a continuous layer of liquid. The layer is equalized by the blade of a preferably adjustable doctor whereby that portion of the liquid layer which is permitted to advance beyond the blade forms a film of desired thickness. If the liquid is an adhesive, the film can be applied directly to a web of cigarette paper or the like, or the film can be transferred onto one or more intermediate rolls before it comes into contact with a portion of or the entire side of a running web. If the liquid contains coloring matter, it is normally transferred onto one or more indicia-bearing imprinting members which are caused to move into contact with selected portions of a running web or with selected portions of blanks for the making of cigarette packs or the like.

A drawback of many presently known apparatus which form and transfer films of adhesive paste, ink or other liquids is that the liquid is permitted to escape from the tank, either along the fountain roll, along the doctor or along the fountain roll and the doctor. In most instances, the liquid can reach the ends of and thereupon drips from the fountain roll to thereby contaminate the apparatus as well as the machine wherein the apparatus is installed. Moreover, liquid which reaches the ends of the fountain roll is likely to form a crust on the shaft for the fountain roll, to penetrate into the bearings for the shaft, to contaminate the drive means which rotate the fountain roll, and/or to evaporate into the surrounding area. The drawbacks of hardened crusts of adhesive on gears, shafts, bearings and analogous parts will be readily apparent; however, inks and other liquids having a relatively low viscosity are also likely to create serious problems if they are free to escape from the vessel. Moreover, the liquids which are used in machines for the processing of tobacco, filter material, packs for cigarettes, cigars or cigarillos and/or other smokers' products are rather expensive so that it is obviously quite desirable to avoid unnecessary wasting of liquids in such machines.

SUMMARY OF THE INVENTION

An object of the invention is to provide a novel and improved apparatus which can form and transfer liquid films of desired thickness in such a way that the waste of liquid is eliminated or reduced well beyond that in heretofore known apparatus.

Another object of the invention is to provide a novel and improved mounting for the fountain roll and doctor in a liquid film forming and transferring apparatus.

A further object of the invention is to provide a liquid film forming and transferring apparatus wherein the liquid is unable to reach and drip form the one and/or other end face of the fountain roll.

An additional object of the invention is to provide a novel and improved doctor and novel and improved adjusting means for the doctor in an apparatus of the above outlined character.

Still another object of the invention is to provide a novel and improved housing for the fountain roll and doctor of the above outlined apparatus.

The apparatus of the present invention comprises a liquid-containing receptacle having an outlet, a fountain roll which is rotatable about a fixed (preferably horizontal) axis and includes a median portion which is adjacent to and extends transversely of the outlet so that liquid issuing from the outlet forms a layer around the periphery of the median portion when the roll is driven to rotate about the fixed axis, sealing elements engaging the periphery of the fountain roll between the median portion and both ends of the roll to prevent the liquid from spreading along the periphery and all the way to the end faces of the roll, and a doctor blade which is adjacent to but spaced from the periphery of the median portion of the fountain roll to determine the thickness of that portion of the layer which is permitted to advance beyond the doctor blade.

The blade preferably forms part of an adjustable cylindrical doctor which is movable substantially radially of the fountain roll and is preferably mounted in a housing for the fountain roll. The doctor is held against rotation in the housing but is movable axially to thereby change the width of clearance between the periphery of the median portion and the doctor blade. Such blade may constitute a shoulder on one end face of the cylindrical doctor.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
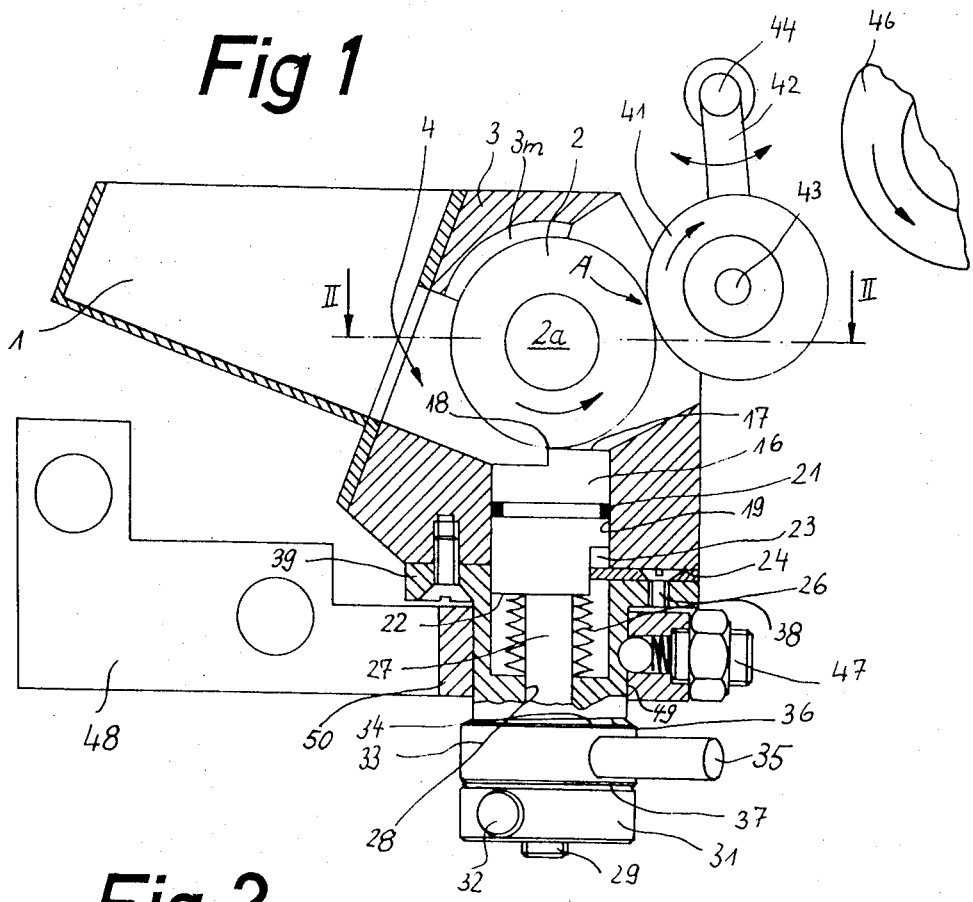
FIG. 1 shows an apparatus which embodies the invention in a vertical sectional view as seen in the direction of arrows from the line I—I of FIG. 2.
Figure 2:
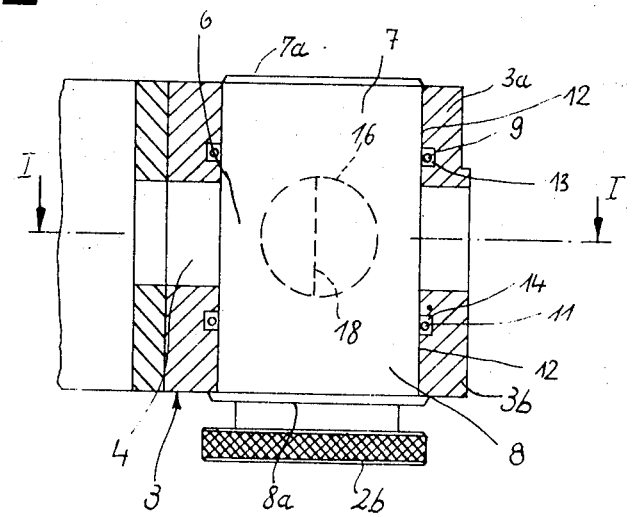
FIG. 2 is a fragmentary horizontal sectional view as seen in the direction of arrows from the line II—II of FIG. 1.

The apparatus of FIGS. 1 and 2 comprises a receptacle here shown as an open-top tank or vessel 1 which can receive and store a supply of liquid (e.g., a coloring matter having a low viscosity or an adhesive paste) which is to be transferred onto the periphery of a liquid applying roll 46. The latter can apply liquid (e.g., coloring matter) to an indicia-bearing imprinting member for the application to selected longitudinally spaced portions of a web or strip of cigarette paper, or continuously to one marginal portion of a web (in the case of adhesive) so that such one marginal portion can be caused to adhere to the other marginal portion and to form therewith a seam. It is assumed that the roll 46 forms part of an imprinting mechanism of the type used in cigarette rod making machines wherein the mechanism applies the name of the manufacturer, the brand name of the cigarette and/or other information to longitudinally spaced portions of a cigarette paper web. As a rule, the roll 46 should receive a very thin and uniform layer or film of liquid to insure a highly reproducible application of information to the paper web. Such thin and uniform layer can be formed if the liquid is being withdrawn from the vessel 1 at a uniform rate and if the withdrawing means does not contaminate the parts of the imprinting apparatus and/or the means for transporting the web toward, through and beyond the imprinting station.

The apparatus further comprises a driven withdrawing roll or fountain roll 2 which is rotatable about a fixed axis defined by a sturdy horizontal shaft 2*a* mounted in a housing 3. The vessel 1 is shown as a separate component part but it is equally within the purview of the invention to provide the housing 3 with an integral receptacle which replaces the vessel 1. The latter has a relatively narrow outlet 4 in the form of a downwardly inclined channel which discharges a stream of liquid against a median portion 6 of the fountain roll 2 (see particularly FIG. 2). This median portion 6 extends transversely of the outlet 4 and is flanked by two outer portions or journal end portions 7, 8 which are rotatable in aligned openings of suitably configurated sleeve-like bearing portions 3*a*, 3*b* of the housing 3. The bearing portions 3*a*, 3*b*, are respectively formed with internal annular grooves 13, 14 for sealing elements 9, 11 (e.g., suitable O-rings) which engage the peripheries of the end portions 7, 8 so as to prevent leakage of liquid from the outlet 4 toward the respective end faces 7*a*, 8*a* of the fountain roll 2. The end portions 7, 8 are received in the bearing portions 3*a*, 3*b* with a certain amount of clearance (shown at 12) but the sealing elements 9, 11 effectively prevent the flow of liquid axially of the roll 2 and beyond the grooves 13, 14 so that a layer of liquid which is being applied to the periphery of the median portion 6 cannot spread axially beyond the sealing elements.

The means for equalizing the layer of liquid which is being applied to the periphery of the median portion 6 during travel past the outlet 4 of the vessel 1 comprises a specially designed sturdy doctor 16 here shown as a cylindrical post which is reciprocable in a vertical cylinder bore 19 of the housing 3. The upper end face 17 of the post 16 is formed with a substantially diametrically extending shoulder 18 constituting a blade and being movable substantially radially of the median portion 6 of the fountain roll 2, i.e., toward and away from the axis of the shaft 2*a*. The blade 18 is parallel to the axis of the roll 2. The surplus liquid which is removed from the layer at the periphery of the median portion 6 remains in the outlet 4. The larger-diameter upper portion of the post 16 has a circumferential groove for a sealing element 21 (e.g., an O-ring) which prevents the liquid from reaching the lower end of the cylinder bore 19 in the housing 3. Those parts of the periphery of median roll portion 6 which advance beyond the shoulder or blade 18 (the fountain roll 2 is assumed to rotate in a counterclockwise direction, as viewed in FIG. 1) carry an equalized layer or film of liquid to a locus A where the film is being transferred (preferably at regular intervals) to the periphery of an oscillatable transfer roll or ductor roll 41. The latter is mounted on a shaft 43 at the lower end of a lever 42 (which is fulcrumed at 44) and is driven to rotate clockwise, as viewed in FIG. 1. The lever 42 is caused to pivot back and forth at predetermined intervals to alternately move the ductor roll 41 into contact with the median portion 6 of the fountain roll 2 or into contact with the periphery of the liquid applying roll 46. The mechanism for pivoting the lever 42 is not shown in the drawing. The shaft 2*a* of the fountain roll 2 carries a pulley 2*b* which is driven by an endless belt, not shown, to rotate the roll 2 counterclockwise, as viewed in FIG. 1. The means for driving the belt which is trained over the pulley 2*b* can also drive the roll 41 and/or 46.

The post 16 is held against rotation in the bore 19 by a projection or tongue 24 which is secured to a separable portion 39 of the housing 3 by one or more screws 26 or analogous fasteners and a portion of which extends into an axially parallel groove 23 in the larger-diameter upper portion of the post 16. Since the bore 19 is formed directly in the housing 3, and since this housing also supports the end portions 7, 8 of the fountain roll 2, the post 16 is not likely to move axially of the roll 2 and the roll 2 is not likely to move axially or radially of the post 16 so that the selected clearance between the blade 18 and the periphery of the median portion 6 remains unchanged even if the housing 3 is caused to vibrate or to perform other unforeseen movements when the machine employing the improved liquid film forming and transferring apparatus is in actual use. It has been found that the mounting of parts 2 and 16 in a common housing contributes significantly to constancy of the selected width of clearance between the blade 18 and the median portion 6. The housing 3 is strong and rigid enough to avoid any likelihood of twisting, flexing or other deformation which could change the width of the clearance between 6 and 18.

The aforementioned axially parallel groove 23 extends upwardly from a lower end face 22 of the larger-diameter upper portion of the post 16. Blocking of rotation of the post 16 in the bore 19 of the housing 3 is desirable because the blade 18 extends substantially or exactly diametrically of the end face 17 and any (even minor) angular displacement of the post 16 would result in a pronounced change of the width of clearance between the blade 18 and the periphery of the median portion 6, i.e., the clearance would remain substantially unchanged at the exact center but would increase toward both ends of the blade 18.

The lower portion 27 of the post 16 constitutes a substantially pin-shaped extension or shank of the larger-diameter upper portion; this extension passes through a bore 28 in the detachable housing portion 39 and its lower end portion is externally threaded, as at 29, to take a nut 31 having a radially outwardly extending handle 32. The detachable portion 39 is secured to the main or upper portion of the housing 3 by screws or analogous fasteners. The nut 31 has a cylindrical peripheral surface and is outwardly adjacent to an annular cam 33 surrounding the extension 27 and having a radially extending handle 35. The lower end face 37 of the cam 33 can lie flush against the adjacent upper end face of the nut 31 but the upper end face 34 of the cam 33 is inclined with respect to the axis of the post 16 (it makes an oblique angle with such axis) to form a cam face or ramp which abuts against an inclined complementary cam face 36 at the underside of the detachable housing portion 39. The post 16 is biased upwardly by a helical spring 38 which reacts against an internal surface of the detachable housing portion 39 and bears against the lower end face 22.

The housing 3 is mounted in a carrier of holder 48 which may form part of or is attached to the frame of the cigarette rod making machine and has a cylindrical bore 49 for the detachable portion 39. The bore 49 is formed in a sleeve 50 of the carrier 48, and this sleeve supports an adjustable detent structure 47 having a spring-biased ball adapted to snap into a socket in the periphery of the housing portion 39 to separably retain the latter in the sleeve 50.

The operation:

The vessel 1 stores a supply of liquid which can be replenished continuously or at regular or irregular intervals. The liquid fills the outlet 4 and forms a layer on the periphery of the median portion 6 of fountain roll 2 whereby such liquid can spread axially of the roll toward but not beyond the sealing elements 9 and 11 so that it cannot reach the end faces *7a*, *8a*. As the fountain roll 2 rotates, the blade 18 of the post 16 converts the layer at the periphery of the median portion 6 into a thin film of uniform thickness. The exact thickness of this film is determined by the axial position of the post 16 in the bore 19, i.e., by the angular position of the cam face 34 on the cam 33 with respect to the cam face 36 of the detachable housing portion 39. The cam 33 constitutes a fine or precision adjusting means and the nut 31 constitutes a coarse adjusting means for the post 16 and blade 18.

The ductor roll 41 swings back and forth at regular intervals to remove portions of the liquid film form the periphery of the median portion 6 when in the end position of FIG. 1 and to apply such portions of the film to the periphery of the liquid applying roll 46 in the other end position. The peripheral speed of the roll 41 may deviate from that of the roll 46 so that the roll 41 crushes and further comminutes the pigment in the liquid carrier of the film which is being transferred to the periphery of the roll 46. Such mode of operation insures that the periphery of the roll 46 receives an extremely thin film of liquid which is ready to be applied to a web (if the periphery of the roll 46 is provided with raised portions resembling the information which is to be applied to the web) or to an indicia-bearing imprinting member, not shown, which receives the film from the periphery of the roll 46.

If the vessel 1 contains a supply of adhesive paste, the ductor roll 41 can be omitted and the fountain roll 2 can apply a thin film of adhesive directly to the periphery of a roller-shaped applicator which rolls on a travelling web of cigarette paper or on a web which is to be subdivided into uniting bands serving to attach filter plugs to plain cigarettes, cigars or cigarillos.

As stated above, the operator will rotate the nut 31 in order to effect coarse adjustments in the distance between the periphery of the median portion 6 and the edge of the blade 18 on the post 16. The nut 31 moves the extension 27 axially to thereby stress or relieve the spring 38. The latter insures that the cam face 34 invariably abuts against the cam face 36 and that the lower end face 37 of the cam 33 invariably abuts against the upper end face of the nut 31. Once the coarse adjustment is completed, the operator rotates (if necessary) the cam 33 relative to the detachable housing portion 39 and nut 31 so that the angular position of the cam face 34 changes (relative to the cam face 36) whereby the post 16 moves upwardly or downwardly while the lower end face 37 of the cam continues to abut against the nut 31.

If the operator wishes to replace the post 16 with a fresh post, the parts 31 and 33 are detached from the extension 27, the housing portion 39 is withdrawn from the sleeve 50 against the opposition of the detent structure 47, and the screw or screws for the detachable portion 39 are removed to thus permit separation of portion 39 from the main housing portion. This enables the operator to withdraw the post 16 from the bore 19 and to insert a fresh post.

The sealing elements 9, 11 and 21 prevent uncontrolled escape of liquid from the vessel 1, and the blade 18 cooperates with the median portion 6 of the fountain roll 2 to insure that the latter continuously withdraws a liquid film of selected thickness. The liquid which is not transferred onto the ductor roll 41 returns into the vessel 1; to this end, the housing 3 has an arcuate cutout *3m* which is located between the bearing portions *3a*, *3b* and wherein the film of liquid can return from the locus A of liquid transfer to the roll 41 into the vessel.

The sealing elements 9, 11 perform the important function of preventing flow of any liquid to the end faces *7a*, *8a* of the roll 2; such liquid could drip into the cigarette rod making machine. The sealing element 21 prevents contamination of the lower portion of the post 16 and of adjusting means for the post. This insures that the blade 18 can be adjusted with utmost accuracy, especially since the housing 3 is common to the roll 2 and post 16 so that no misalignment of the blade 18 can take place in normal operation of the apparatus. Moreover, such mounting of the parts 2, 16 in a common housing contributes to compactness of the apparatus which is important in cigarette making and other tobacco or filter processing machines.

In many presently known apparatus, the doctor resembles a thin plate or sheet which must be mounted with a high degree of accuracy. Such sheet or plate normally extends along the full axial length of the fountain roll so that it is quite likely to be flexed and/or otherwise distorted with attendant changes in the width of the clearance between the blade and the periphery of the fountain roll. It has been found that a cylindrical or post-shaped doctor is less likely to be distorted than a sheet-or plate-like doctor. Moreover, vibrations of the improved apparatus are less likely to change the clearance between the blade of a cylindrical doctor and a fountain roll and the blade of a plate- or sheet-like doctor. A cylindrical doctor in the form of a post can stand substantial bending, twisting and other deforming stresses without appreciable changes in the clearance between its blade and the fountain roll. The diameter of the doctor 16, namely the length of the blade 18, need not appreciably exceed the width of the outlet 4, i.e., the diameter of the doctor can be much less than the axial length of the fountain roll between the end faces *7a* and *8a*. While it is also within the purview of the invention to provide a cylindrical doctor with a thin blade which cooperates with the median portion 6 to define the thickness of the liquid film advancing toward the locus A, the configuration which is shown in the drawing is preferred at this time because a thin blade is more likely to be distorted than a shoulder which is machined directly into the upper end face of the post.

Without further analysis, the foregoing will so fully reveal the gist of the present invention that others can, by applying current knowledge, readily adapt it for various applications without omitting features which fairly constitute essential characteristics of the generic and specific aspects of our contribution to the art and, therefore, such adaptations should and are intended to be comprehended within the meaning and range of equivalence of the claims.

What is claimed as new and desired to be protected by Letters Patent is set forth in the appended claims:

1. In an apparatus for forming and transferring films of a liquid, particularly for applying liquid films to roller-shaped applicators in tobacco processing machines, a combination comprising a housing including spaced-apart first and second bearing portions having aligned openings therein and a liquid-containing receptacle having an outlet disposed between said bearing portions; a fountain roll rotatable about a fixed axis and having a median portion adjacent to and extending transversely of said outlet so that liquid issuing from said receptacle forms a layer around the periphery of said median portion when said roll rotates about said axis, said roll further having first and second journal end portions respectively mounted in the openings of said first and second bearing portions and the diameters of said end portions being identical with the diameter of said median portion; circumferentially complete first and second sealing rings respectively engaging the peripheries of said first and second end portions to prevent the liquid from spreading axially to the ends of said roll, said first and second sealing rings being respectively located in the openings of said first and second bearing portions; means for rotating said fountain roll; and a doctor mounted in said housing and having a blade adjacent to but spaced from the periphery of said median portion to control the thickness of that portion of said layer which passes beyond said blade when said roll rotates about said axis.

2. A combination as defined in claim 1, wherein the axial length of said median portion approximates the length of said blade.

3. A combination as defined in claim 1, wherein said doctor comprises a post having an end face provided with a shoulder which constitutes said blade.

4. A combination as defined in claim 3, wherein said housing has a bore and said post is axially movable in said bore to thereby change the width of clearance between said median portion and said blade.

5. A combination as defined in claim 4, wherein said post is disposed substantially radially of said median portion and said shoulder extends substantially diametrically of said end face and in parallelism with the axis of said fountain roll.

6. A combination as defined in claim 4, wherein said post includes a cylindrical portion which is received in said bore and further comprising sealing means provided in said bore between said cylindrical portion and said housing.

7. A combination as defined in claim 6, further comprising means for preventing rotation of said cylindrical portion in said bore.

8. A combination as defined in claim 7, wherein said rotation preventing means comprises a projection provided in said housing and extending into an axially parallel peripheral groove of said cylindrical portion.

9. A combination as defined in claim 4, further comprising adjusting means for moving said post axially in said bore.

10. A combination as defined in claim 9, wherein said adjusting means comprises a cam rotatably mounted on said post and having a cam face making an oblique angle with the axis of said post and abutting against said housing.

11. A combination as defined in claim 10, wherein said cam is a ring and said cam face constitutes an end face of said ring, said housing having a complementary second cam face abutting against said first mentioned cam face.

12. A combination as defined in claim 10, further comprising means for biasing said cam against said housing.

13. A combination as defined in claim 10, further comprising means for moving said cam axially of said post.

14. A combination as defined in claim 13, wherein said post comprises an externally threaded extension and said means for moving said cam axially comprises a nut meshing with said extension.

* * * * *

UNITED STATES PATENT OFFICE
CERTIFICATE OF CORRECTION

Patent No. 3,996,890 Dated December 14, 1976

Inventor(s) Werner RINGE and Jürgen GÖMANN

It is certified that error appears in the above-identified patent and that said Letters Patent are hereby corrected as shown below:

Foremost page, item [73], "Hauni-Werke Korber & Co., KG" should read --Hauni-Werke Körber & Co. KG--.

Col. 1, line 50, "rotate" should read --rotates--.

Col. 5, line 34, "form" should read --from--.

Col. 6, line 52, --than the clearance between a fountain roll-- should be inserted before "and".

Signed and Sealed this

Fifth Day of April 1977

[SEAL]

*Attest:*

RUTH C. MASON
*Attesting Officer*

C. MARSHALL DANN
*Commissioner of Patents and Trademarks*